US007690181B2

(12) United States Patent
Lassmann

(10) Patent No.: US 7,690,181 B2
(45) Date of Patent: Apr. 6, 2010

(54) METHOD FOR OPERATING A TEXTILE MACHINE PRODUCING CROSS-WOUND BOBBINS

(75) Inventor: Manfred Lassmann, Nettetal (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 31 days.

(21) Appl. No.: 12/079,034

(22) Filed: Mar. 24, 2008

(65) Prior Publication Data

US 2008/0237385 A1 Oct. 2, 2008

(30) Foreign Application Priority Data

Mar. 31, 2007 (DE) ..... 10 2007 015 695

(51) Int. Cl.
*D01H 4/50* (2006.01)

(52) U.S. Cl. ..... 57/263; 57/264

(58) Field of Classification Search ..... 57/263, 57/264, 265

See application file for complete search history.

(56) References Cited

U.S. PATENT DOCUMENTS 5,586,427 A * 12/1996 Pohn et al. ..... 57/264
6,035,622 A * 3/2000 Fox et al. ..... 57/263
6,339,921 B1 * 1/2002 Lassmann et al. ..... 57/264
6,761,022 B2 * 7/2004 Zipperer ..... 57/263

FOREIGN PATENT DOCUMENTS

DE 4235450 A1 5/1993

* cited by examiner

*Primary Examiner*—Shaun R Hurley
(74) *Attorney, Agent, or Firm*—K&L Gates LLP

(57) ABSTRACT

A method for operating a spinning machine with plural spinning stations (1), each case having a take-off roller device (6, 10, 14) for drawing a yarn (9) from a spinning device (2) and a sensor mechanism (26) for checking piecings. When starting a piecing, the theoretical conveying length of the yarn is determined based on the surface speed of the rollers (10, 14), until the piecing reaches the sensor mechanism (26). The deviation of the theoretical conveying length from a desired yarn length, corresponding to the spacing between the spinning device (2) and the sensor mechanism (26), is detected. The deviation is compared with a preadjustable limit value of the permissible deviation. If the limit value is passed, this indicates intolerable wear of the pressure roller (14) and produces a signal.

8 Claims, 1 Drawing Sheet

METHOD FOR OPERATING A TEXTILE MACHINE PRODUCING CROSS-WOUND BOBBINS

CROSS-REFERENCE TO RELATED APPLICATIONS

This application claims the benefit of German patent application 10 2007 015 695.4, filed Mar. 31, 2007, herein incorporated by reference.

BACKGROUND OF THE INVENTION

The present invention relates to a method for operating a textile machine producing cross-wound bobbins and, more particularly, a spinning machine with a plurality of spinning stations each case having a take-off device with a take-off roller and a pressure roller for drawing off a yarn from a spinning device and a sensor mechanism for checking piecings.

German Patent Publication DE 42 35 450 A1 describes a method for determining the diameter of a bobbin at a spinning station of a spinning machine, in which method the speed of the feed roller, the rotor speed, the speed of the take-off and the winding roller are detected by means of sensors to determine the bobbin diameter. The yarn length which is used as a basis for a specific bobbin diameter is empirically determined by means of these variables. The empirically determined yarn length is used as a reference value here to which the actually measured yarn length is related. In this context, German Patent Publication DE 42 35 450 A1 names external influences, the occurrence of which influences the determination of the bobbin diameter. The use of pressure rollers with a different degree of hardness and which are possibly run-in is mentioned as an influencing factor of this type, inter alia. Pressure rollers worn in this manner result in the occurrence of different slip at the take-off rollers. The irregular wear of entraining rubbers on friction rollers is mentioned as a further influencing factor, which results in a different winding tension of the yarn. To compensate the influence of these factors on the bobbin diameter to be determined, German Patent Publication DE 42 35 450 A1 provides for the formation of correction values, which enter the determination of the diameter. The determination of the correction values described in German Patent Publication DE 42 35 450 A1 does not, however, supply any indication as to how wear of this type and its progress could be recognised.

Thus, in particular in the case of textile machines, the spinning stations of which carry out the piecing, process automatically without the aid of a so-called piecing or maintenance carriage, it is not only important to know about the current state of wear of pressure rollers against the background of determining the diameter of a bobbin, but also against the background of the quality of the piecings. Thus, for example, an inadequate parallelity of the pressure roller to the take-off element, caused by an irregular wear of the pressure roller, leads to an influencing of the piecing. This influencing can lead to the piecing not having the strength of the remaining spun yarn. An increasing take-off slip caused by the pressure roller wear may be expressed in the case of an open-end rotor spinning machine in that the piecing undergoes a higher increase in mass and a greater twist because of the higher residence time of the piecing in the spinning rotor and in the fiber flow. The higher mass causes the rotation to be deflected substantially into the thinnest point, the normal yarn region upstream of the piecing which leads to an over-twisting and therefore a weakening in this region. In order to be able to prevent this situation, knowledge about the state of wear of the pressure roller is of particular importance, in particular for the piecing process. The visual check of pressure rollers which is carried out represents, however, a disproportionate effort which is also unreliable with regard to its significance about the current state of wear.

SUMMARY OF THE INVENTION

The invention is based on the object of providing a method for operating a textile machine which allows automatic recognition of the wear of pressure rollers.

This object is achieved according to the invention by a method for operating a spinning machine with a large number of spinning stations, each of which comprises a take-off device with a take-off roller and a pressure roller for drawing off a yarn from a spinning device and a sensor mechanism for checking piecings. The invention is characterised by the following steps: (a) at the start of a piecing, the theoretical conveying length of the yarn is determined on the basis of the surface speed of the pair of take-off rollers, until the beginning of the piecing has reached the sensor mechanism, (b) the deviation of the theoretical conveying length from a desired yarn length, corresponding to the spacing between the spinning device and the sensor mechanism, is detected, (c) the deviation is compared with a preadjustable limit value of the permissible deviation, and (d) passing the limit value is evaluated as an indicator of intolerable wear of the pressure roller and is signalled. The present invention further provides for a statistical detection of the theoretical conveying length over a predeterminable number of piecings to form an average value, the standard deviation of which is compared with a preadjustable limit value, and passing this limit value is also evaluated as an indicator of intolerable wear of the pressure roller and is signalled.

Further advantageous embodiments, features and advantages of the invention are described more fully hereinafter.

The inventive method according to above summary provides that at the start of a piecing, the theoretical conveying length of the yarn is determined on the basis of the surface speed of the pair of take-off rollers, until the beginning of the piecing has reached the sensor mechanism, that the deviation of the theoretical conveying length from a desired yarn length, corresponding to the spacing between the spinning device and the sensor mechanism, is detected, that the deviation is compared with a preadjustable limit value of the permissible deviation, and that passing the limit value is evaluated as an indicator of intolerable wear of the pressure roller and is signalled. The method according to the invention makes it possible for the user, even independently of a visual appraisal of the piecing, to permit an assessment of the quality of the piecing. In this case, the quality reduction thus determined can be attributed in a reproducible manner to the wear of the pressure rollers. It can thus be avoided that piecings, which lie outside specifiable limits, are allocated to a certain class of defects in the assumption that faulty piecing parameters are present although the actual cause of the quality deviation occurring is not due to the piecing parameters. This lack of certainty with regard to the cause of poor quality in piecings can lead to faulty decisions easily being made with regard to the parameterisation of the piecing process in optimisation tests. This can be avoided by the method according to the invention in that the piecings with a measurable take-off slip on passing a limit value are separated and are allocated to a new class of defects of their own.

Advantageously, a statistical detection of the theoretical conveying length over a specifiable number of piecings may take place to form an average value of the theoretical yarn length, the deviation of which from the desired yarn length is compared with the limit value.

Likewise, a detection of the theoretical conveying length of only one piecing may take place, the deviation of which is compared with the limit value and is recorded when the limit value is exceeded. In this manner, a cyclic monitoring of the wear of the pressure rollers may be set up as well as a monitoring which can be carried out at irregular intervals, in that one or more piecings are evaluated according to the inventive method at certain intervals. The process of cyclic monitoring may preferably be adjusted centrally at the control device. An unscheduled monitoring by an operator can also be initialised at irregular intervals by means of the control device.

The evaluation of the deviation may preferably be logged and stored. The logging of the exceeding of the limit value allows the user to be informed about the state of the pressure rollers, so he is put in a position to also check the current state of wear of pressure rollers even in relation to an individual spinning station. This check allows the user to exchange the pressure roller before possible drawbacks in the yarn test values, for example the yarn extension or the piecing reliability can be recognised at a spinning station.

Depending on the quality requirement, the specifiable limit value for the deviation from the desired yarn length or the predeterminable limit value for the permissible standard deviation should be specifiable by the user within a defined range, which can be adjusted at the textile machine. For this purpose, the limit value may be preadjusted in a range between 5 mm and 30 mm.

Alternatively, to achieve the object according to the above method, it is proposed that with the beginning of a piecing, the theoretical conveying length of the yarn is determined on the basis of the surface speed of the pair of take-off rollers, until the beginning of the piecing has reached the sensor mechanism, in that a statistical detection of the theoretical conveying length takes place over a specifiable number of piecings to form an average value, the standard deviation of which is compared with a preadjustable limit value, the passing of the limit value being evaluated as an indicator of intolerable wear of the pressure roller and is signalled. This method takes into account the occurring variance on the basis of the different degree of wear on the surface of the pressure roller as the position of the yarn to be drawn off differs between the rollers of the pair of take-off rollers in the axial direction. Thus, the wear in the edge regions of the pair of delivery rollers is generally less than in the centre, which leads to different slip. The exceeding of the preadjusted limit value by the determined value of the standard deviation is used as an indicator for the wear of the pressure roller. A standard deviation above a limit value defined by the user, produced in the evaluation of the measuring lengths, thus allows a conclusion as to whether the take-off slip is no longer randomly dependent on the instantaneous mass of the piecing and the spinning tension, but is substantially determined by the current state of wear of the pressure roller. The statistical evaluation allows early recognition of a wear situation which, in particular, can negatively influence the quality of the piecings with regard to strength and appearance.

The theoretical conveying length can preferably be determined by counting increments of an incremental sensor. For this purpose, the take-off roller of the take-off device may be configured, for example, as an incremental sensor or a motor being used as the drive of the take-off device may have an incremental sensor.

Alternatively, the theoretical conveying length can be determined with the aid of the step number of a stepping motor driving the take-off device.

The method according to the invention can be carried out on spinning machines, such as, for example, open-end rotor spinning machines or air spinning machines, only one control device being provided to carry out the method according to the invention, which control device is set up for the statistical evaluation of the deviation of a measured theoretical conveying length from a desired yarn length at a spinning station.

This object may preferably be carried out by the respective spinning station computer of a spinning station and/or a central control device of the spinning machine.

BRIEF DESCRIPTION OF THE DRAWINGS

The invention will be described in more detail below with the aid of an embodiment shown in the drawing, wherein.

DETAILED DESCRIPTION OF THE PREFERRED EMBODIMENTS

Figure 1:
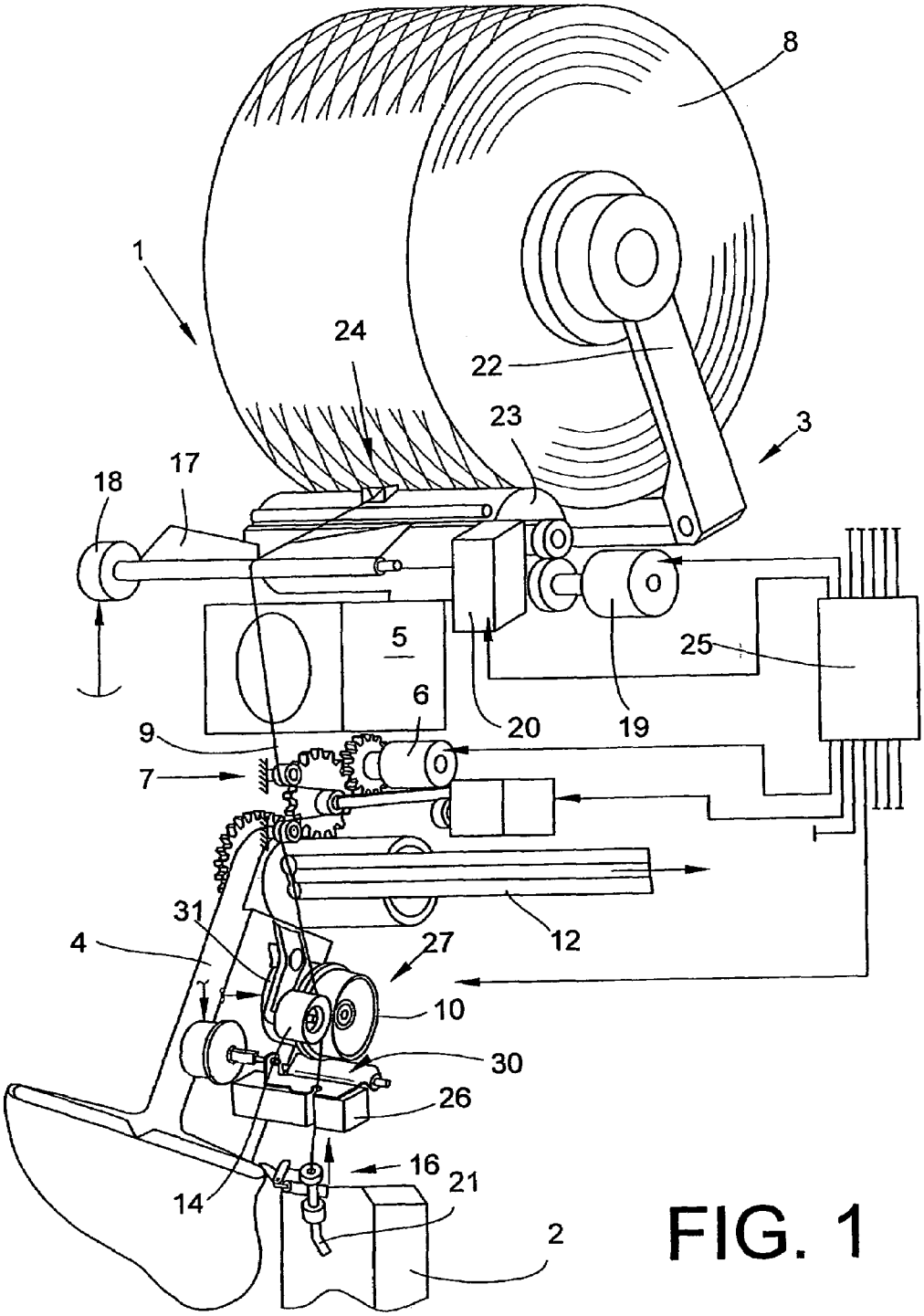
FIG. 1 shows a perspective view of a spinning station of an open-end rotor spinning machine.

The spinning station 1 of an open-end rotor spinning machine shown in FIG. 1 has a spinning device 2 for producing a yarn 9 and a winding device 3 which is downstream in the yarn running direction. The yarn 9 is wound to form a cross-wound bobbin 8 on this winding device 3.

The yarn 9 produced in the spinning device 2 is drawn from the spinning device 2 by a yarn take-off device 27, which has a yarn take-off roller 10 which can be driven by a single motor, as well as a pressure roller 14 which can be placed on the yarn take-off roller 10 and is entrained thereby by frictional engagement. To avoid point-wise wear of the yarn take-off roller 10 and pressure roller 14, an auxiliary yarn guide 30 is also arranged in the region of the yarn take-off mechanism 27, which auxiliary yarn guide traverses the running yarn 9 while it is being drawn off.

As also indicated in FIG. 1, the yarn 9 leaves the spinning device 2 through a so-called yarn take-off tube 21, in the region of which a pivotably mounted auxiliary piecing member 16 is also arranged, which, after a yarn break, takes over the yarn 9 returned from the cross-wound bobbin 8 by a suction nozzle 4 and prepares the yarn end for repiecing.

Arranged in the region of yarn running path are also a stop motion 26, a mechanical yarn storage mechanism 7, a pneumatic yarn storage mechanism 12 and a waxing mechanism 5.

The winding device 3 consists of a creel 22 for the rotatable holding of a cross-wound bobbin 8, a bobbin drive drum 23 which can preferably be driven by means of a reversible single drive 19, as well as a yarn traversing mechanism 24, which is driven, for example, by means of a stepping motor 20. A yarn centring mechanism in the form of a pivotably mounted centring plate 17 may also be arranged upstream of the yarn traversing mechanism 24 and can be folded in a defined manner by a drive 18 and before regular yarn running paths, if necessary. Furthermore, spinning stations 1 of this type have a suction nozzle 4 which can be adjusted by means of a stepping motor 6 in a defined manner between a yarn receiving position located in the region of the winding device 3, and a yarn transfer position located in the region of the spinning device 2. The individual stepping motors of the spinning station 1 are connected to a spinning station computer 25 via various control lines.

The requirement to assess whether wear has occurred and to what extent wear on the pressure roller has advanced is determined according to the invention by detecting the deviation of the theoretical conveying length from a desired yarn length.

The spacing between the spinning device 2 and the stop motion 26 is constant due to the design and, in the present embodiment described, represents the desired yarn length. The theoretical conveying length, which describes the yarn length, which can theoretically be drawn off, of a yarn take-off device 27 working without slip, is determined with the aid of the step number of a stepping motor 31 being used as a single motor drive for the yarn take-off roller 10, which step number is detected until the beginning of the piecing is detected by the stop motion 26. As an alternative to the stepping motor 31, a drive may be provided with has an incremental sensor, or the yarn take-off roller 10 has an incremental sensor. The theoretical conveying length may be determined, therefore, using the detected number of increments.

The deviation of the theoretical conveying length from the desired yarn length, caused by the take-off slip due to wear occurring at the pressure roller 14 is compared with a preadjustable limit value for a permissible deviation. The passing of the limit value is evaluated as an indicator of intolerable wear of the pressure roller 14 and signalled. The signalling may take place directly at the respective spinning station but likewise also at a central control device of the spinning machine.

The limit value of the deviation from the desired yarn length, the passing of which triggers an indication of intolerable wear, can be specified within a range of between 5 mm and 30 mm by an operator, and can be adjusted at the spinning station computer 25 or at a central control device of the textile machine and transferred from there to the spinning station computer 25. During the adjustment of the limit value, the quality aimed for the yarn or the piecings is important; the lower a limit value is specified, the higher is the quality aimed for.

So a representative value of the deviation can be determined, the determined theoretical conveying length for a relatively large number of piecings is statistically detected and evaluated by the spinning station computer 25. The average value formed of the theoretical conveying length is compared to the desired yarn length and the deviation resulting therefrom is then compared with the predetermined limit value. If the deviation of the determined theoretical conveying length exceeds the limit value, the slip occurring is no longer randomly dependent on the instantaneous mass of the piecing and the spinning tension but predominantly on the current state of wear of the pressure roller 14. The method according to the invention naturally also allows detection of the theoretical conveying length of at least one piecing, the deviation of which from the theoretical conveying length is compared with the limit value and if the limit value is exceeded, is recorded, it being possible for the operating personnel to carry out the detection cyclically or at irregular intervals, if necessary.

The continuous logging of the exceeding of the limit value allows conclusions about the current state of the pressure roller 14. The operator is therefore put in a position to be informed about the current state of the pressure rollers 14 at each individual spinning station 1 without having to subject each individual pressure roller 14 to a visual inspection. This allows the timely exchange of the pressure rollers 14 before disadvantages in the yarn test values, such as, for example, the sporadic spinning of a yarn which is too coarse because of a reduced take-off, caused by slip, can be recognised in an increased yarn rotation, yarn rotation, yarn test values or winding tension, in the bobbin build-up or in the piecing reliability. In cases in which it is established because of the monitoring according to the invention that the wear is intolerable, it can be directly signalled to the operating personnel that an exchange is necessary to maintain the quality of the production process.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. In the operation of a spinning machine with a plurality of spinning stations (1), each comprising a take-off device (27) with a take-off roller (10) and a pressure roller (14) for drawing off a yarn (9) from a spinning device (2) and a sensor mechanism (26) for checking piecings, a method of detecting the wear condition of the pressure roller characterised by the following steps:

at the start of a piecing, the theoretical conveying length of the yarn (9) is determined on the basis of the surface speed of the pair (10, 14) of take-off rollers, until the beginning of the piecing has reached the sensor mechanism (26), the deviation of the theoretical conveying length from a desired yarn length, corresponding to the spacing between the spinning device (2) and the sensor mechanism (26), is detected, the deviation is compared with a preadjustable limit value of the permissible deviation, and passing the limit value is evaluated as an indicator of intolerable wear of the pressure roller (14) and signals an alert to a user indicative of the wear of the pressure roller.

2. Method according to claim 1, characterised in that a statistical detection of the theoretical conveying length takes place over a specifiable number of piecings to form the average value of the theoretical yarn length, the deviation of which from the desired yarn length is compared with the limit value.

3. Method according to claim 1, characterised in that a detection takes place of the theoretical conveying length of a piecing, the deviation of which is compared with the limit value and is recorded when the limit value is exceeded.

4. Method according to claim 1, characterised in that the evaluation is logged and stored.

5. Method according to claim 1, characterised in that the limit value is preadjusted in a range between 5 mm and 30 mm.

6. In the operation of a spinning machine with a plurality of spinning stations (1), each comprising a take-off device (27) with a take-off roller (10) and a pressure roller (14) for drawing off a yarn (9) from a spinning device (2) and a sensor mechanism (26) for checking piecings, a method of detecting the wear condition of the pressure roller characterised by the following steps:

at the start of a piecing, the theoretical conveying length of the yarn (9) is determined on the basis of surface speed of the pair (10, 14) of take-off rollers, until the beginning of the piecing has reached the sensor mechanism (26), a statistical detection of the theoretical conveying length takes place over a predeterminable number of piecings to form an average value, the standard deviation of which is compared with a preadjustable limit value, and passing the limit value is evaluated as an indicator of intolerable wear of the pressure roller (14) and signals an alert to a user indicative of the wear of the pressure roller.

7. Method according to claim 1 or 6, characterised in that the theoretical conveying length is determined by counting increments of an incremental sensor.

8. Method according to claim 1 or 6, characterised in that the theoretical conveying length is determined with the aid of the step number of a stepping motor (31) driving the draw-off device (27).

* * * * *